US005899040A

United States Patent [19]

Cerrato

[11] Patent Number: 5,899,040

[45] Date of Patent: May 4, 1999

[54] FLEXIBLE INTERLOCKING WALL SYSTEM

[76] Inventor: Dominic Cerrato, 162 Township Hwy. 202, Bloomingdale, Ohio 43190

[21] Appl. No.: 08/925,311

[22] Filed: Sep. 8, 1997

[51] Int. Cl.[6] ..... E04B 5/04; E04C 2/04

[52] U.S. Cl. ..... 52/604; 52/223.7; 52/309.12; 52/405.3; 52/503; 52/590.2; 52/592.1; 52/592.6

[58] Field of Search ..... 52/604–608, 589.1, 52/590.1–590.3, 592.1, 505, 223.5, 223.7, 503, 309.12, 309.16, 309.17, 405.3, 592.6

[56] References Cited

U.S. PATENT DOCUMENTS

| | | | |
|---|---|---|---|
| 676,803 | 6/1901 | Shaw . | |
| 690,811 | 1/1902 | Waller . | |
| 729,408 | 5/1903 | Pickin . | |
| 748,603 | 1/1904 | Henry . | |
| 859,663 | 7/1907 | Jackson . | |
| 868,838 | 11/1907 | Brewington . | |
| 1,562,728 | 11/1925 | Albrecht . | |
| 1,684,050 | 9/1928 | Adams . | |
| 2,392,551 | 1/1946 | Roe . | |
| 2,655,032 | 10/1953 | Zagray . | |
| 2,902,852 | 9/1959 | Lofstrom . | |
| 3,378,969 | 4/1968 | Larger . | |
| 3,534,518 | 10/1970 | Zagray . | |
| 3,618,279 | 11/1971 | Sease . | |
| 4,115,980 | 9/1978 | Martel et al. | 52/591 |
| 4,726,567 | 2/1988 | Greenberg . | |
| 5,138,808 | 8/1992 | Bengtson et al. . | |
| 5,355,647 | 10/1994 | Johnson et al. . | |

FOREIGN PATENT DOCUMENTS 1.293.147 of 1961 France .

*Primary Examiner*—Christopher Kent
*Assistant Examiner*—Yvonne Horton-Richardson

[57] ABSTRACT

A masonry wall system is disclosed incorporating a plurality of courses of masonry blocks, each block consisting of interlocking dovetails along with vertical and horizontal mating surfaces. The main block, has two stabilizing holes running at a vertical axis through the center. Steel reinforcement rods or square tubes are loosely inserted into these stabilizing holes at predetermined intervals. Comer blocks are employed to connect the walls at right angles and are a] so used in conjunction with short blocks to staggered the vertical joints from course to course. The predetermined tolerances between the masonry components and the loosely placed rods or tubes permit the wall to have a fluid property. Forces such as settling, hydrostatic pressure and seismic disturbances are then automatically absorbed and systematically distributed across the entire wall. When all of the masonry components reach the end of their tolerance, the wall locks up as a solid interconnected mass. The force is then passed on to the stabilizing rods or tubes which now act to stabilize the wall against further movement.

14 Claims, 5 Drawing Sheets

FIG. 3
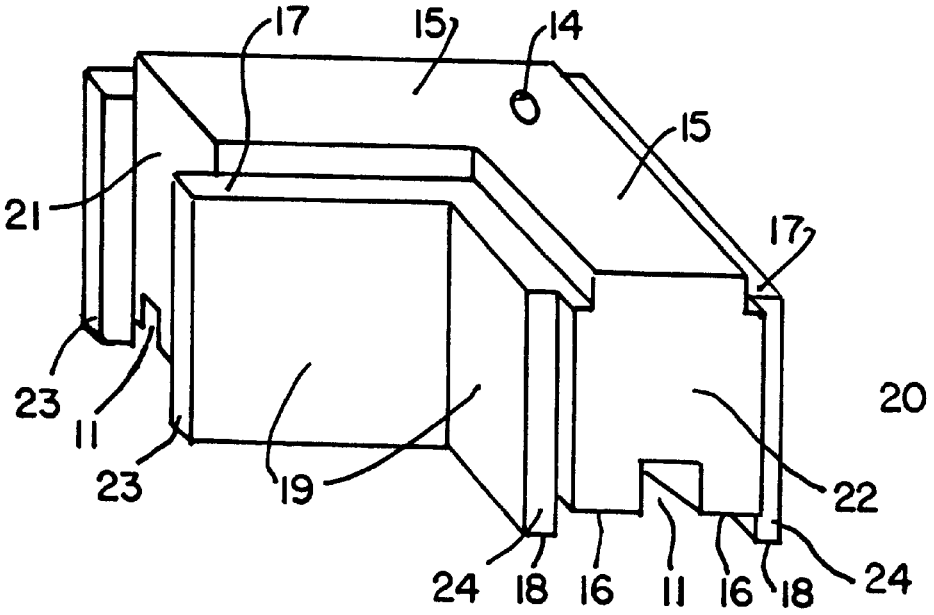
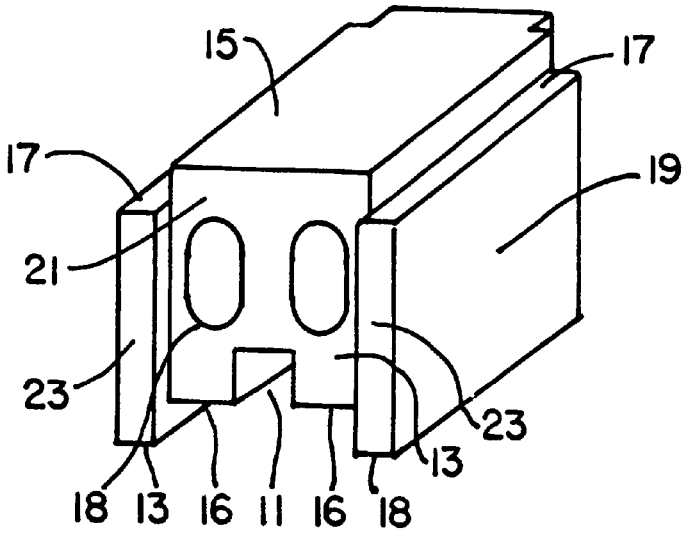
FIG. 4

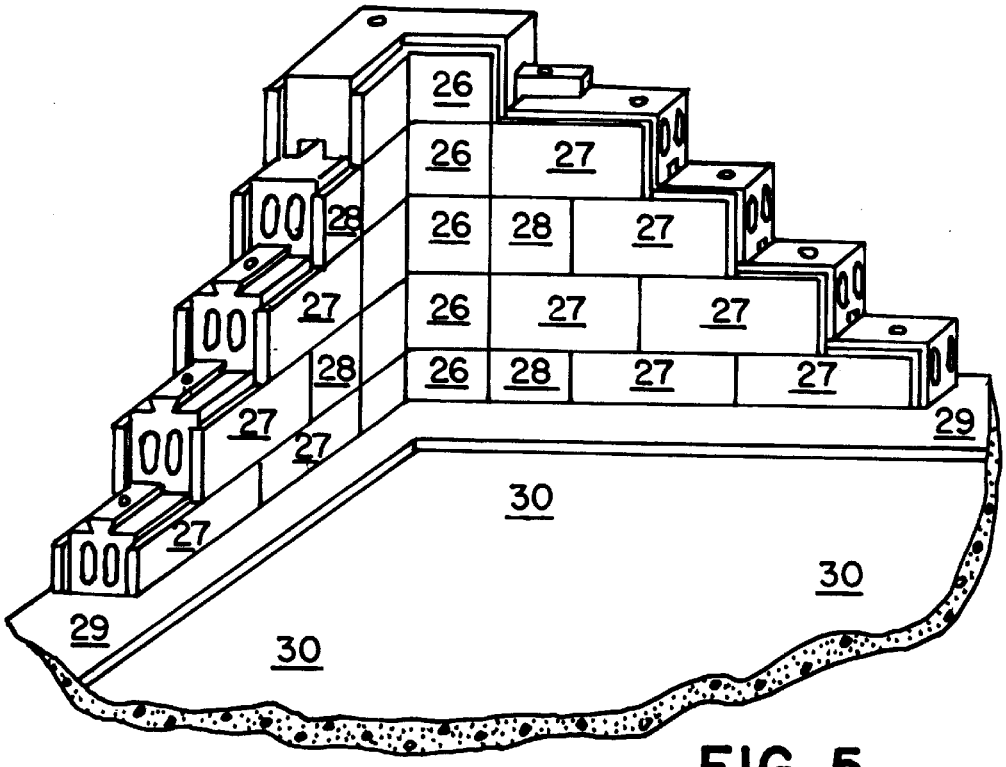
FIG. 5
FIG. 6
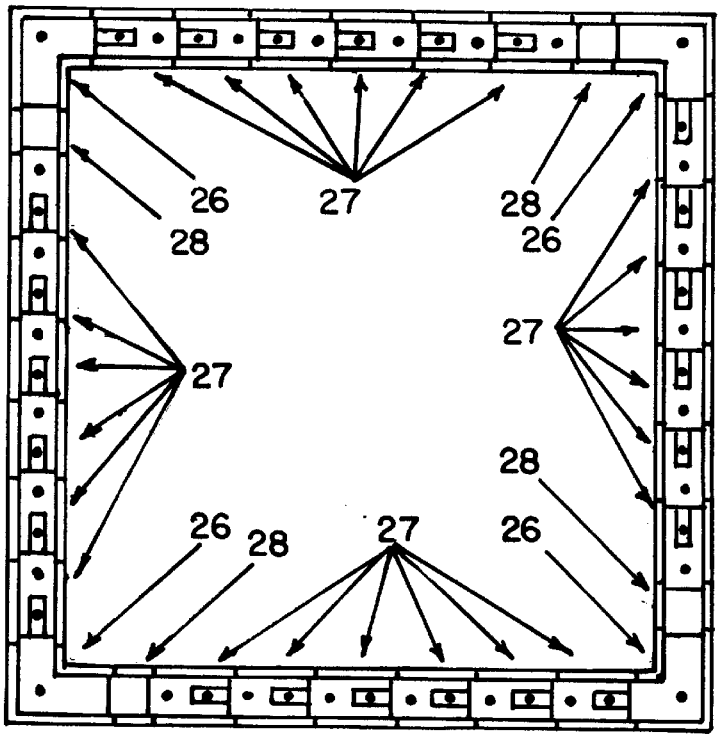

FLEXIBLE INTERLOCKING WALL SYSTEM

BACKGROUND-FIELD OF INVENTION

This present invention relates to an improvement in free-standing mortarless building structures and, in particularly, to a virtually mortarless interconnecting block system with unique dynamic properties.

BACKGROUND OF THE INVENTION

Typically speaking, free-standing masonry walls are constructed of concrete blocks (or similar material) in running courses. Each course is placed in such a manner so that the vertical joints are staggered from the previous course. Mortar is used as a binding agent between the courses and between the ends of each of the blocks. Conventional concrete blocks typically have one or more voids extending through them in the vertical direction to create vertical columns through the walls. Reinforcing bars are placed in these columns for enclosure within a continuous mortar masses within the columns, in accordance with building code standards. Such columns typically are placed approximately four feet apart along the length of the wall.

Although this type of free-standing masonry wall has been used successfully in residential, commercial and industrial construction, it possesses a considerable number of drawbacks. These include: the necessity of skilled labor for assembly (not handyman friendly), the requirement of mortar as a binding agent between each of the components, the considerable time demanded for construction, the inability to disassemble components and reuse if desired, the incapacity to absorb external pressure changes (such as settling, hydrostatic pressure and seismic disturbances) without significant deterioration to the structural integrity.

Several types of blocks and wall systems have been proposed to overcome some of these deficiencies. Beginning in 1901, U.S. Pat. No. 676,803 to Shaw, disclosed an interlocking block system that employed a combination of tongues and groves along with dovetails to secure each block to the adjacent blocks. This was followed by similar designs in U.S. Pat. Nos. 690,811 to Waller, 748,603 to Henry; 868,838 to Brewington; 1,562,728 to Albrecht; 2,902,853 Loftstrom; and, French Patent No. 1,293,147. Although the use of interlocking male and female dovetails provide a positive lock and represent a significant improvement over similar tongue and grove construction, all of the dovetails used in this conventional art embody a critical disadvantage in terms of assembly. When these are employed (as in the case of: U.S. Pat. No. 676,803; French Patent No. 1,293,147; U.S. Pat. Nos. 748,603; 1,562,728; and, 2,902,853) on the upper and lower surfaces of the block, the female dovetail of each new block must be slid over a number of male dovetails on the lower course into the appropriate position. Given the dimensional inaccuracies of common block material along with the tolerances necessary to slide the new block into place, binding is a frequent occurrence. Despite a long-felt but unresolved need for handyman friendly construction material, this frequent assembly problem, along with the various proprietary components, kept assembly to skilled professionals.

While much of the conventional art, to a certain degree, overcomes some of the difficulties associated with the requirement of mortar, and the inability to disassemble, none provide for the capacity to automatically absorb external pressure changes without significant deterioration in structural integrity. Attempts to address this particular problem have come in the form of steel reinforcement of some kind.

In 1907, U.S. Pat. No. 859,663 to Jackson employed steel post, tension-threaded reinforcement rods in combination with steel frames to produce a very strong wall. The use of steel post, tension-threaded reinforcement rods can also be seen in: U.S. Pat. Nos. 3,378,969 to Larger; 859,663 to Jackson; 4,726,567 to Greenburg; 5,138,808 to Bengtson et al.; and, 5,355,647 to Johnson et al.

Unfortunately, this move to steel reinforcement as a means to counter external pressure meant the loss of many of the gains achieved by much of the conventional art. In short, the characteristics of:mortarless construction and the ability to disassemble components and reuse them were sacrificed for a stronger wall.

Although the addition of steel to bind the wall in a solid mass contributed to it structural integrity by better resisting certain external forces, this is only true in the case of a force applied in one direction against the wall. As in the case of hydrostatic pressure, the force moves only in one direction; from the outside to the inside, slowly and steadily. Seismic disturbances, such as those associate with earthquakes, tend to move the earth in a rapid back and forth motion. A wall bound as a sold mass is unable to accommodate the dynamic back and forth movement. Instead, its rigid composition directly transfers the force to the rest of the building (acting as sort of a lever) weakening the integrity of the entire structure until it finally fails.

Thus, it is desirable to provide a masonry wall system that incorporates the advantages of: unskilled labor for assembly; mortarless construction; the ability to disassemble and reuse; and, the necessary capacity to automatically absorb external pressure changes (particularly seismic disturbances) without significant deterioration of structural integrity. Such a wall system would create a new synergy that would satisfy a long-felt but unresolved need. It would also represent a positive contribution to the masonry industry.

SUMMARY OF THE INVENTION

Accordingly it is an object of the present invention to provide an improved masonry walls system that does not require skilled labor to assemble.

It is another object of the present invention to provide a masonry wall system that does not require mortar for it's construction.

It is a further object of the present invention to provide an improved masonry wall system that is capable of rapid, on-site assembly.

It is still another object of the present invention to provide an improve masonry wall system that can be disassembled and then reused.

It is still an additional object of the present invention to provide an improved masonry wall system that overcomes the conventional problems of masonry assembly in which dovetail structures are used.

It is yet another object of the present invention to provide an improved masonry wall system that is capable of absorbing external pressure changes (such as settling, hydrostatic pressure and seismic disturbances) without significant deterioration in the structural integrity of the wall system.

It is yet a further object of the present invention to provide an improved masonry wall system that is capable of distributing stress on any portion of the wall throughout a large surrounding segment of the wall.

These and other objects and goals of the present invention are achieved by an interlocking mortarless wall system having a plurality of main blocks. Each of the main blocks includes at least one stabilizing hole positioned to be vertically collinear with the stabilizing holes of other blocks when the blocks are arranged in the interlocking position with respect to each other. Each of the main blocks also includes a dovetail structure on the upper surface and a slot on the lower surface configured to fit the dovetail. This permits dovetails to move laterally to a predetermined extent when the block is interlocked with the vertically adjacent blocks. The system also includes a reinforcing structure placed in the stabilization holes through a plurality of the main blocks. The reinforcing structure is sized to permit movement of the blocks in a horizontal plane for the predetermined extent of movement. Movement to the predetermined extent transfers the stress causing the block movement to adjacent blocks.

In another embodiment of the present invention, an interlocking mortarless wall system includes a plurality of interlocking blocks. Also included in the system are means for interlocking the vertical adjacent blocks to each other. Means for permitting lateral movement of adjacent vertical blocks to a predetermined extent of movement and for locking the blocks once the predetermined extent of movement has been reached are also included. Once the predetermined extent of movement has been reached means for transferring the stress on a first block throughout the wall via adjacent blocks come into operation.

BRIEF DESCRIPTION OF THE DRAWINGS

FIG. 1(*b*) is a perspective diagram depicting the rear view of the block of FIG. 1(*a*).

FIG. 3 is a perspective diagram depicting a corner block.

FIG. 4 is a perspective diagram depicting a short block.

FIG. 5 is a perspective diagram depicting a partially assembled wall using the inventive system.

FIG. 6 is a top view of the first course of a wall constructed according to the present invention.

DETAILED DESCRIPTION OF THE PREFERRED EMBODIMENT

Figure 1A:
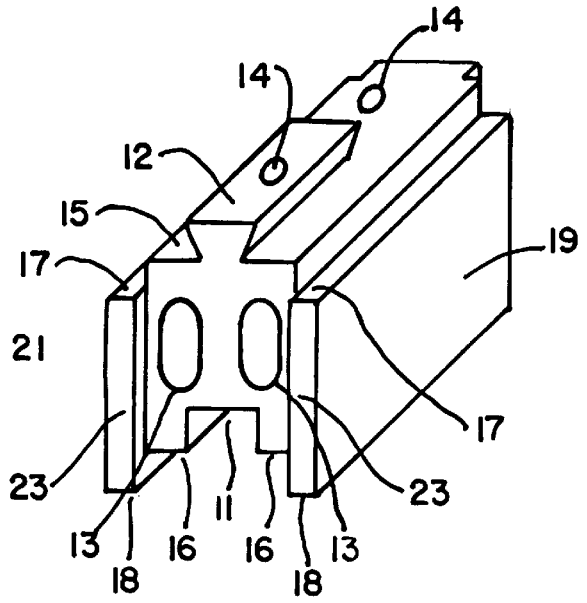
FIG. 1(*a*) is a perspective diagram depicting the main block component of the inventive wall system.
Figure 1B:
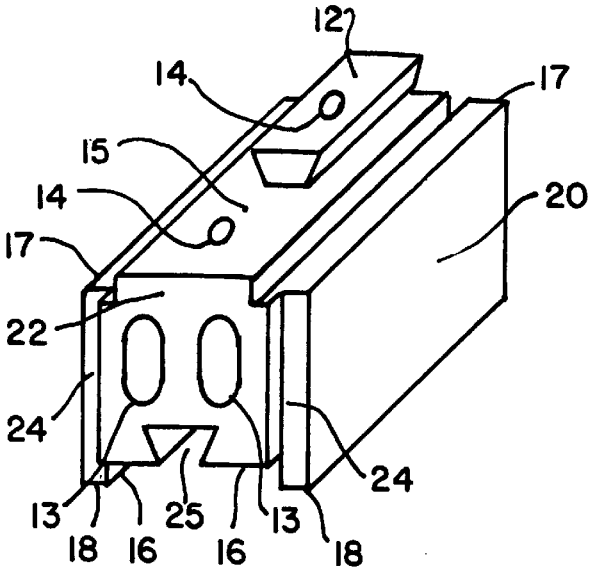

FIGS. 1(*a*) and 1(*b*) depict two perspective views of the main block constituting the present invention. The drawing designation numerals included in FIGS. 1(*a*) and 1(*b*) remain the same for all of FIGS. 1(*a*)–10. For the sake of clarity and efficient consideration of all of the drawings, the legend of the drawing designation numerals is provided below:

| | |
|---|---|
| 11.square receiving slot | 21.front plane |
| 12.dovetail | 22.rear plane |
| 13.through holes | 23.front shoulder |
| 14.stabilizing holes | 24.rear shoulder |
| 15.upper plane | 25.dovetail receiving slot |
| 16.lower plane | 26.corner block |
| 17.upper shoulder | 27.cynderbrick |
| 18.lower shoulder | 28.short block |
| 19.interior sides | 29.footer |
| 20.exterior sides | 30.foundation |

The wall system of the present invention is essentially composed of three basic components. These include: a main block, a corner block, and short block. The main block, shown in FIGS. 1(*a*) (front view) and 1(*b*) (rear view), is the fundamental component upon which the entire wall system is based. It is rectangular in its general shape and possess a number of crucial features that set it apart from the conventional art. Situated on the upper plane 15 is a male dovetail 12 extending up from the front plane 21 and back to approximately one-half the length of the cynderbrick. Running along the lower plane 16, parallel to the male dovetail 12 on the upper plane 15, is the combination square receiving slot 11 and dovetail receiving slot 25. The square receiving slot 11 runs approximately one-half the length from the front plane 21 and then gradually turns into the dovetail receiving slot 25.

This feature enables a new main block to be placed directly over the top of a main block on the lower course. Here, the square receiving slot 11 of the main block freely receives the dovetail 12 of the main block on the lower course. The new main block is then slid one-half its length so that, as the square receiving slot 11 turns into dovetail receiving slot 25 on the new main block, it engages the male dovetail 12 on the main block on the lower course and is locked into position staggering the vertical joints. This feature overcomes the assembly difficulties found in prior art where each new block must be slid over a number of other blocks on the lower course into the appropriate position. It is also easier to fit the blocks of the present invention onto other such blocks than with similar conventional art interlocking wall systems. This is due to the fact that the tolerances between the dovetails and the dovetail slots of the present invention are quite large so that there is easy assembly. The use of large tolerances between the interlocking pieces has benefits that are explained infra. On the other hand, in conventional interlocking wall systems, the tolerances between the slots and pieces that are meant to extend into the slots are quite small. The resulting tight fits are necessary for the proper assembly of such conventional art walls but make the assembly quite difficult. This drawback is not shared by the system of the present invention.

Figure 8:
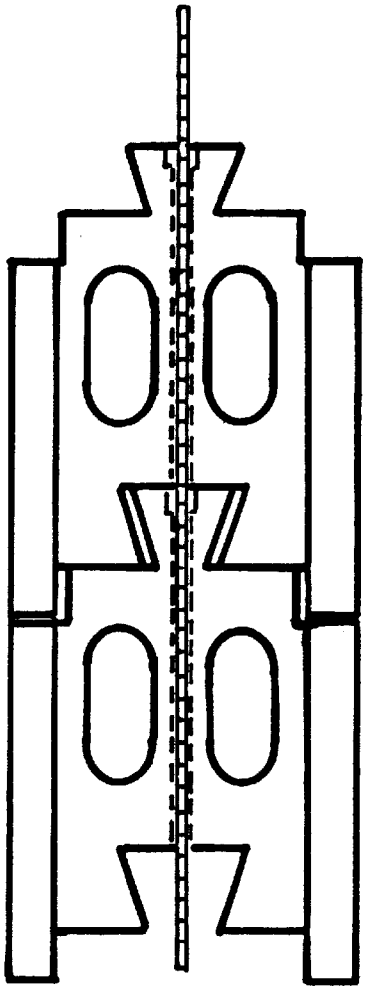
FIG. 8 is a cross sectional view of the structure of FIG. 7 under different external conditions.
Figure 7:
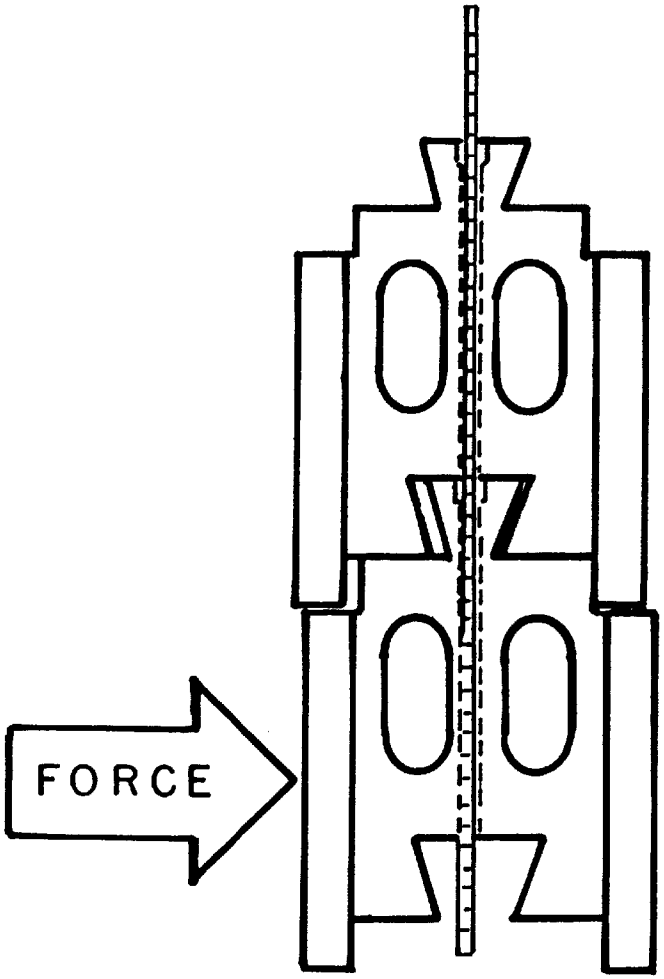
FIG. 7 is a cross sectional view of a portion of a wall assembled according to the present invention, under 1 set of external conditions.
Figure 9:
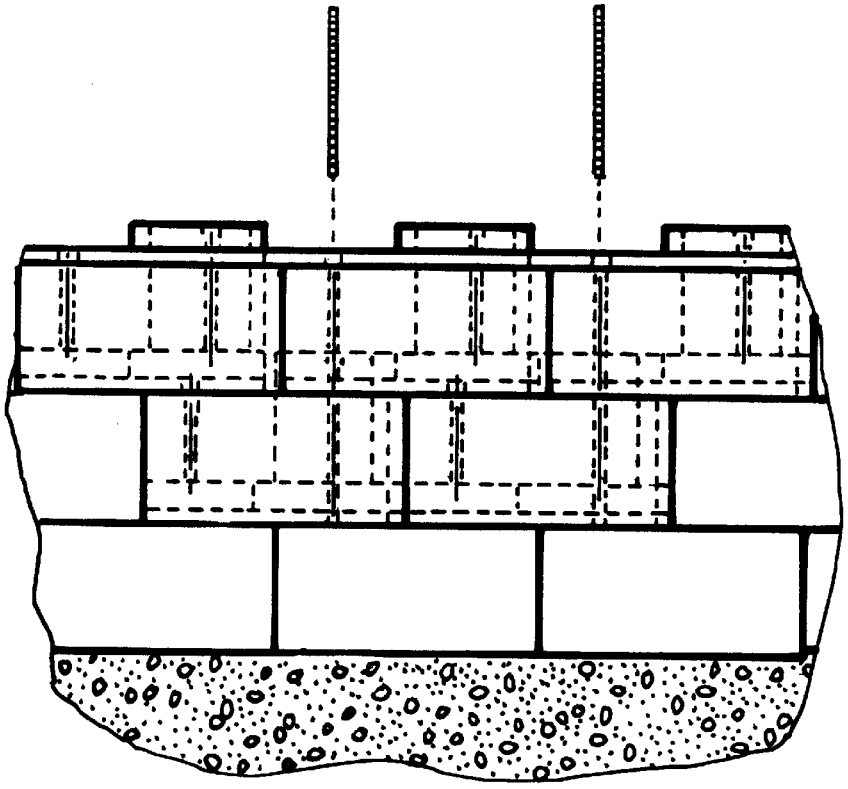
FIG. 9 is an elevation view of the wall according to the present invention, depicting placement of reinforcement rods.

The sides of the main block 19, 20 are off-set (in a parallel manner) both horizontally and vertically creating interlocking shoulders 17, 18, 23, 24 when mated to adjacent blocks. This provides the blocks with horizontal and vertical stability. The lower shoulder 18 also acts as a drip edge resisting water penetration. Running at a vertical axis through the center of the main block are two stabilizing holes 14. These hole loosely accommodate either steel reinforcement rods or square tubing as shown in FIGS. 7, 8 and 9. Optional through holes 13 may be added to reduce the amount of cement and/or other material used to manufacture the component.

Figure 2:
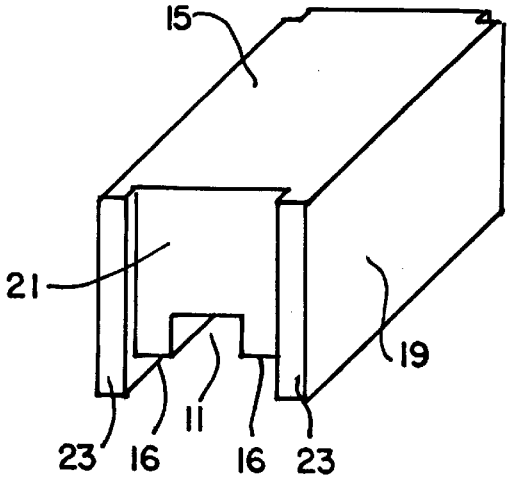
FIG. 2 is a perspective diagram depicting a sill cap.

Both the corner block shown in FIG. 3 and the short block shown in FIG. 4 employ the same features as the main block with the exception of the interlocking dovetail. The interconnection of these components is illustrated in FIGS. 5 and 6. A sill cap, as depicted in FIG. 2 is employed over the top of the last course to help lock the course of blocks into place, and to provide a surface for subsequent framing if required.

While the aforementioned blocks may appear similar to those found in the conventional art examples, the differences that have been pointed out are very significant with respect to the manner in which the wall operates to distribute external stress. While all interlocking blocks possess some play by virtue of the tolerances necessary to interconnect them, none possess the attribute of variable dynamic resistance. The term, dynamic resistance, can be defined as the property of a structure to slightly give under pressure and then lock up as a solid mass at a given point. Thus, variable dynamic resistance is dynamic resistance that can be adjusted to suit construction and environmental requirements.

The operation of this property is effected by a combination of block fit tolerances and the use of either steel reinforcement rods or square tubing loosely placed through the stabilizing holes 14 at the top. By changing the number of rods and their placement, a considerable degree of variation can be achieved. Simply put, more rods in more places means less fluidity and more rigidity. Conversely, fewer rods in fewer places means more fluidity and less rigidity. This property substantially increases wall integrity and reduces the common cracking found in contemporary wall construction. Also, the tolerance between the stabilizing hold and the forcing rods can also be adjusted to adjust the degree of wall movement permitted.

When forces such as hydrostatic pressure are exerted against the wall surfaces, each cynderbrick moves slightly. The first movement occurs proximate to the pressure. As this block moves to its predetermined tolerance (when the dovetail jambs against the side of the slot and the reinforcing rod jambs against the side of the whole containing it), it automatically locks in place and then transfers this force to the six adjacent blocks (two top, two bottom and two sides, see FIG. 10). These blocks likewise move a predetermined extent until they reach the end of their tolerance and then they, in turn, transfer the force to the other adjoining blocks. This allows the entire wall to progressively and systematically absorb the force moving gradually as it does. This radial transfer is illustrated in FIG. 10 where the darker areas represent the greater degree of stress and earlier lock-up in the progression.

Strategically placed within the wall are either steel reinforcement rods or square tubing as seen in FIG. 9. These run in a vertical fashion and are used to stabilize the wall when it reaches the end of its tolerance and locks up. Unlike all of the conventional art, the steel reinforcement rods or square tubing are loosely placed with the vertical holes as depicted in FIG. 8. This space between the hole and the reinforcing rod (along with the tolerance between the block dovetails and their associated slots) permit movement of the wall up to a point. This is when the side of the dovetail jambs tight against the side of it's respective slot and the reinforcing rod jambs tightly against the hole through which it is placed. Thus, these elements act in conjunction to provide controlled movement and positive lock-up.

When the wall is in locked-up state, all of the blocks have reached the end of their predetermined tolerances and the force is now transferred to either the steel reinforcement rods or the square tubing as shown in FIG. 7. This transfer is possible because the space between the steel reinforcement rods and the vertical holes in the cynderbricks are reduced as a result of the block movement up to this point. The reinforcing rods now act to stabilizing the structure. This, in turn, further limits the movement of the wall and positively acts to resist the applied pressure. Because of the interlocking dovetails and the manner in which the horizontal and vertical surfaces connect, each block contributes to resist the force. Thus, the present structure operates to distribute the force on any particular block or blocks, as depicted in FIG. 10. As a result, instead of all the force being placed upon the block (depicted as the darkest block in FIG. 10), the force is distributed to surrounding blocks and in diminishing measure to those blocks surrounding them.

Figure 10:
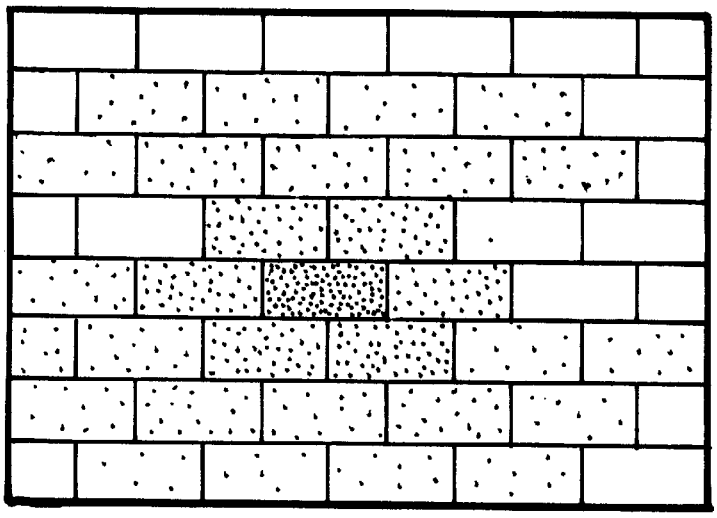
FIG. 10 is an elevation view depicting the distribution of force on a wall according to the present invention.

By spreading the force as depicted in FIG. 10, it is far less likely that sufficient stress will be built up on one block or group of blocks to cause the wall to fail at a particular point. This makes the wall a strong interconnected mass able to withstand far more force than its traditional counterparts.

There are five factors that contribute to the property of variable dynamic resistance. These can be divided into two general categories: fixed and variable. The fixed factors are those designed within the system and cannot be altered unless the dimensions are modified. These include the overall size of the cynderbrick, the tolerance between each cynderbrick and the size of the stabilizing holes. The variable factors are those that can be adjusted by the assembler. Among these are: the number and placement of the either the steel reinforcement rods or the square tubing.

The unique physical characteristics of the masonry components, working in conjunction with the loosely placed rods/tubing, produces the highly efficient distribution of force over a large segment of the wall, enabling the wall not only to accommodate gradual directional forces such as settling and hydrostatic pressure, but rapid omnidirectional forces such as seismic disturbances. The wall structure which facilitates the property of variable dynamic resistance, creates a technique for dealing with omnidirectional external pressures.

The flexible walls of the present invention can accommodate the movements found in earthquake zones. In contrast, the rigid conventional walls, such as those found in residential foundations, will directly transfer the seismic force to the rest of the building cumulatively weakening the integrity of the structure until it eventually fails. Not only does the present invention overcome this significant problem, but it also has the added features of:

(a) providing an improved masonry wall system that does not require skilled labor to assemble;

(b) providing an improved masonry wall system that is mortarless in construction;

(c) providing an improved masonry wall system with rapid on-site assembly;

(d) providing an improved masonry wall system that can be disassembled and reused;

(e) providing an improved masonry wall system that overcomes the problems commonly associated with dovetail assemble.

Although the above description contains many specific details, these should not be construed as limiting the scope of the present invention but as merely providing illustrations of some of the presently preferred embodiments of the invention. Thus, the present invention should be considered to include any and all variations, permutations, modifications and adaptations that would occur to any skilled practitioner that has been taught to practice the present invention. For example, it is envisioned that other components using the same features may be added later such as: partition blocks, end caps and lintels. Thus, the scope of the invention should be determined by the appended claims and their legal equivalents, rather than the examples given herein.

I claim:

1. An interlocking, mortarless wall system having at least one major surface, each forming a wall face, said system, comprising:

(a) a plurality of main blocks, each main block comprising (i) at least one stabilizing hole, said stabilizing hole positioned to be vertically collinear with stabilizing holes in other blocks when positioned with respect to each other in an interlocking configuration to form a wall face, (ii) dovetail structure on an upper surface of said main block, (iii) a slot in a bottom surface of said main block configured fit said dovetail structure, and permitting said dovetail structure to slide in a direction perpendicular to said wall face within said slot to a predetermined extent when said main block is in an interlocked configuration with vertically adjacent main blocks; and, (b) a plurality of reinforcing structures placed in said stabilization holes through a plurality of said main blocks, each said reinforcing structure is being sized to permit movement of said main blocks in a horizontal plane for said predetermined extent, whereby horizontal movement to said predetermined extent transfers stress to adjacent blocks causing block movement of adjacent blocks.

2. The system of claim 1, wherein said slot extends for the entire length of said main block, one half of said length of said slot being configured to accommodate said dovetail and the other half of said length of said slot being configured to fit said dovetail.

3. The system of claim 2, further comprising:

(c) a footer upon which said main blocks are placed.

4. The system of claim 3, wherein said main blocks further comprise (10) longitudinal holes extending the full length of said blocks to reduce material containment therein.

5. The system of claim 2, wherein said main blocks further comprise (v) a lower surface, (vi) two lateral end surfaces, and (vii) a pair of side panels extending longitudinally on either side of main block, said side panels being arranged below said upper surface and extending beyond said lower surface of said main block.

6. The wall system of claim 5, wherein said main block is configured so that said side panels extend beyond one of said lateral end surfaces, and are offset from said second lateral end surface to form spaces for extending side panels from adjacent main block.

7. The system of claim 6, further comprising:

(d) a plurality of corner blocks wherein each said corner block is formed at a 90° angle so that a first lateral end surface is arranged perpendicular to a second lateral end surface, and said corner block further comprises a slot arranged so that one half the length of said slot extends 90° from another half of said slot.

8. The system of claim 7 further comprising:

(e) a plurality of short blocks wherein each said short block is approximately one half the length of said main blocks, and said short block is formed with a slot in the short block's lower surface extending it's entire length of said short block.

9. The wall system of claim 8, further comprising:

(f) a plurality of sill cap blocks arranged for placement as a top course of said wall system, said top block having a planar upper surface and a slot in a lower surface running the entire length of said sill cap block.

10. An interlocking mortarless wall system having at least one major surface, each forming a wall face, said system comprising:

a plurality of interlocking blocks forming a wall face;

means for interlocking vertical adjacent blocks;

means for permitting movement in a direction perpendicular to said wall face and locking of adjacent vertical blocks at a predetermined extent of movement; and, means for transferring stress on a first block throughout said wall via blocks adjacent to said first block.

11. The wall system of claim 10, wherein said means for interlocking vertical adjacent blocks comprise:

dovetails mounted on one half of an upper surface of said blocks and said slots formed in an under surface along the entire length of each said block and arranged to hold said dovetail in a vertically adjacent block in order to allow lateral movement to a predetermined extent.

12. The wall system of claim 10, wherein said means for interlocking further comprise a longitudinal side panels arranged to extend below said blocks and over one lateral surface of said blocks to form a series of extensions and recesses for interlocking both horizontal and vertical adjacent blocks.

13. The system of claim 10, wherein said means for transferring comprise reinforcing structures extending vertically through a plurality of said blocks.

14. The wall system of claim 13, wherein said reinforcing structures are contained within cavities having sufficient size to permit said blocks to move a predetermined distance before said reinforcing structures jamb against said cavities.

* * * * *